US009447784B2

(12) United States Patent
Nawrocki

(10) Patent No.: US 9,447,784 B2
(45) Date of Patent: Sep. 20, 2016

(54) DIAPHRAGM WITH PASSIVE FLOW RATE CONTROL FOR COMPRESSION STAGE

(71) Applicant: Thermodyn, Le Creusot (FR)

(72) Inventor: Gilles Nawrocki, Le Breuil (FR)

(73) Assignee: Thermodyn, Le Creusot (FR)

( * ) Notice: Subject to any disclaimer, the term of this patent is extended or adjusted under 35 U.S.C. 154(b) by 545 days.

(21) Appl. No.: 13/860,968

(22) Filed: Apr. 11, 2013

(65) Prior Publication Data

US 2013/0272909 A1 Oct. 17, 2013

(30) Foreign Application Priority Data

Apr. 11, 2012 (FR) ..... 12 53314

(51) Int. Cl.

| | |
|---|---|
| ***F04D 29/44*** | (2006.01) |
| ***F04B 45/04*** | (2006.01) |
| ***F04D 29/68*** | (2006.01) |
| ***F04D 27/02*** | (2006.01) |
| ***F04D 17/12*** | (2006.01) |

(52) U.S. Cl.

CPC ..... *F04B 45/04* (2013.01); *F04D 17/122* (2013.01); *F04D 27/0207* (2013.01); *F04D 29/444* (2013.01); *F04D 29/681* (2013.01)

(58) Field of Classification Search

USPC ..... 415/173.7, 209.2, 203, 224, 191, 199.2, 415/199.3; 417/472, 44.9, 112, 395, 413.1

See application file for complete search history.

(56) References Cited

U.S. PATENT DOCUMENTS

| | | | | |
|---|---|---|---|---|
| 2,305,226 | A | 12/1942 | Stalker | |
| 3,313,105 | A * | 4/1967 | Johnson | F01D 25/162 184/6.11 |
| 6,554,570 | B2 * | 4/2003 | Dailey | F01D 5/18 415/115 |
| 6,647,707 | B2 * | 11/2003 | Dev | F02C 3/045 415/68 |
| 7,624,580 | B2 * | 12/2009 | Fukutani | F01D 5/082 60/39.08 |
| 7,685,824 | B2 * | 3/2010 | Dahm | F02K 7/16 60/224 |
| 7,758,307 | B2 * | 7/2010 | Van Heusden | F01D 9/042 415/209.2 |
| 8,157,571 | B2 * | 4/2012 | Kadomatsu | H01R 24/50 439/63 |
| 2007/0147987 | A1 | 6/2007 | Kirtley | |

FOREIGN PATENT DOCUMENTS

GB 937987 A 9/1963

OTHER PUBLICATIONS

Preliminary Search Report for corresponding Application No. FR 1253314 (dated Jan. 17, 2013).

* cited by examiner

*Primary Examiner* — Binh Q Tran

(74) *Attorney, Agent, or Firm* — Mintz Levin Cohn Ferris Glovsky and Popeo, P.C.; Steven M. Jensen

(57) ABSTRACT

A diaphragm for the compression stage of a compressor includes least one set of through passages extending between two mutually opposite faces of the diaphragm, so as to create a flow of gas between the opposite faces depending on a pressure difference prevailing on either side of the diaphragm.

3 Claims, 2 Drawing Sheets

DIAPHRAGM WITH PASSIVE FLOW RATE CONTROL FOR COMPRESSION STAGE

This application claims priority under 35 U.S.C. §119(a) to French Patent Application No. 1253314, filed Apr. 11, 2012. The entire content of this application is hereby incorporated by reference herein.

The present invention relates to compressors and, in particular, centrifugal compressors. It relates more particularly to the control of the aerodynamic stability of the compressors, at low flow rate.

The compressors generally comprise an electric motor and a compressor set, for example with a plurality of stages, which comprises a set of blade wheels borne by a shaft. The motor rotationally drives a rotor which is coupled to the shaft of the compressor. In operation, the gas being handled is admitted as input for the compressor then transmitted to the successive compression stages of the compressor group to be discharged at the output of the compressor.

The characteristic curve of the compression supplied by a compressor, which represents the discharge pressure as a function of flow rate, is dependent on a series of parameters, such as the suction pressure, the rotor rotation speed, the nature of the gas compressed, etc.

It has been found that, at low flow rates, that is to say at flow rates below the stability range of the compressor, aerodynamic instabilities occur which correspond to an occurrence of a separation of the flow of gas manipulated by the compressor and to the phenomenon known as "pumping".

Such instabilities, downstream of the blade wheel, are likely to cause vibrations, even damage to the constituent elements of the compressor and limit, in all cases, the operating range of the machine.

This is why it has been proposed, for low-pressure applications, to provide the compressors and in particular the diffusers provided downstream of the wheels, with bladings with variable settings, with respect to the bladed diffusers, or moving walls, with respect to the smooth diffusers. However, such bladings are generally displaced by mechanical devices which require drill holes in the body of the rotating machine and, consequently, the provision of additional devices to ensure the seal-tightness.

Such solutions consequently limit their use to pressures generally below 20 bar.

It has moreover been proposed to provide the compressors with anti-pumping protection devices, providing a connection between the discharge and the suction, in order to artificially increase feed flow rate of the compressor.

Such devices require the use of instrumentation with which to measure the flow rate passing through the compressor, as well as the suction and discharge pressures, as well as monitoring devices driving a gas recirculation control valve.

Such solutions are consequently relatively costly, difficult to implement and likely to be the cause of malfunctions.

The aim of the invention is therefore to overcome the drawbacks associated with the solutions according to the prior art and to reduce the risks of the occurrence of the pumping phenomena and, in particular, the phenomena of instability of the gases circulating in the diffuser of the compressor.

The subject of the invention is, therefore, according to a first aspect, a diaphragm for the compression stage of a compressor, comprising a set of at least one through passage extending between two mutually opposite faces of the diaphragm, so as to create a flow of gas between said faces depending on the pressure difference prevailing on either side of the diaphragm.

According to another feature, this diaphragm comprises a set of passages arranged regularly in the diaphragm and each extending, on one of the faces of the diaphragm, between two fixed blades provided on the diaphragm.

Another subject of the invention, according to a second aspect, is a compression stage of a compressor, comprising a diaphragm receiving a gas supplied at the input of said stage, a bladed wheel ensuring a compression of the gas obtained from the diaphragm and an output diffuser.

The diaphragm comprises a set of at least one through passage extending between a first face of the diaphragm directed towards the suction of gas into the compression stage and a second face directed towards the diffuser so as to create a flow of gas between the diffuser and the area of gas intake into the diaphragm.

According to another feature, this compression stage comprises a set of passages arranged regularly in the diaphragm and each extending, on one of the faces of the diaphragm, between two fixed blades provided on the diaphragm.

Yet another subject of the invention is in particular a centrifugal compressor, comprising a diaphragm for each compression stage as defined hereinabove.

Other aims, features and advantages of the invention will become apparent on reading the following description, given purely as a nonlimiting example, and with reference to the appended drawings in which:

FIG. 1 shows a cross-sectional view of a compression stage of a multi-stage compressor according to the invention.

In the exemplary embodiment represented, the compressor is a centrifugal compressor and is intended to ensure the compression of a gas taken upstream of the stage and delivered downstream at a higher pressure.

Figure 1:
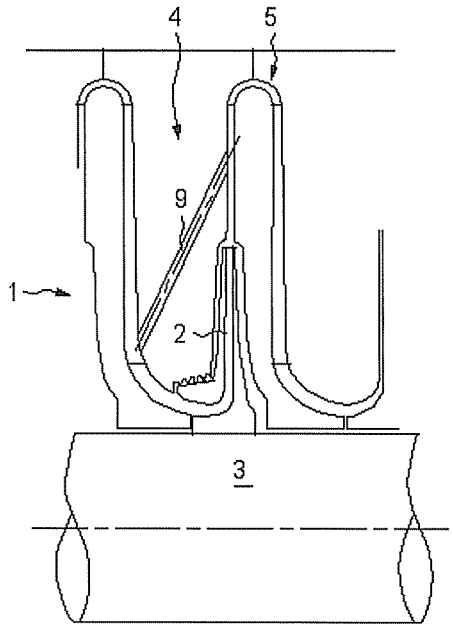
FIG. 1 is a schematic view in cross section of a compression stage of a centrifugal compressor according to the invention.
Figure 2:
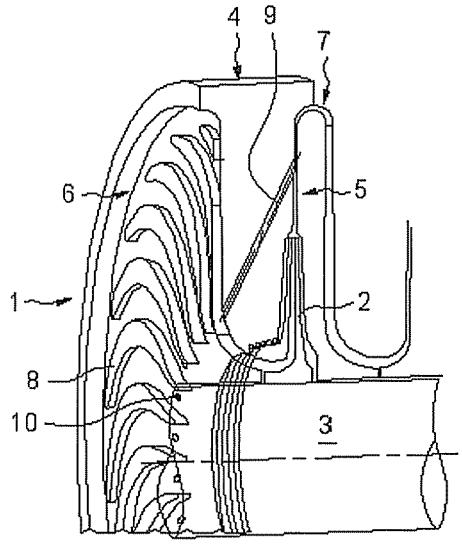
FIG. 2 is a profile view of the compression stage of FIG. 1, showing the gas passages at the input of the compression stage.
Figure 3:
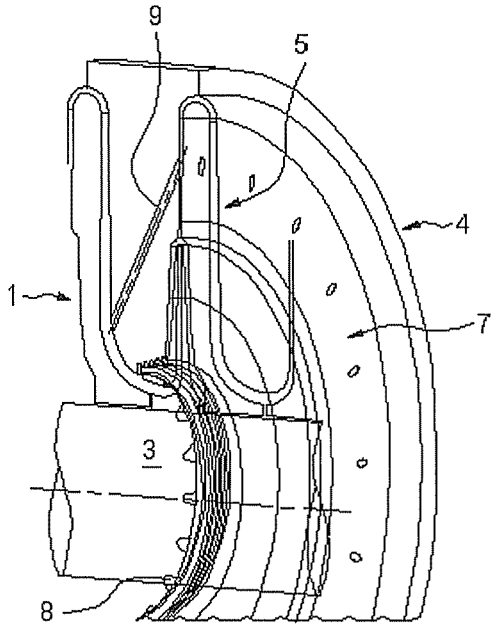
FIG. 3 is a profile view of the compression stage of FIG. 1, showing the gas passages at the diffuser.

Moreover, in FIGS. 1 to 3, the compression stage is an intermediate stage arranged between two compression stages. However, obviously, the invention also applies to the input and output stages.

As can be seen, the compression stage, designated by the general numeric reference 1, comprises a bladed wheel 2 driven in rotation by a rotor 3 which is in turn coupled to a shaft (not represented) driven in rotation by an electric motor.

Upstream of the wheel 2, that is to say on the gas suction side, the compression stage comprises a diaphragm 4 intended to connect the input of the compression stage 1 with the output of a compression stage placed immediately upstream as well as a diffuser 5 intended to slow down the speed of the gases from the bladed wheel 2 and thereby increase the pressure at the output of the stage 1.

By referring also to FIG. 2, in which elements identical to those of FIG. 1 bear the same numeric references, the diaphragm 4 has a substantially annular form and constitutes, with the diffuser 5, one of the stator parts of the compression stage.

It comprises two mutually opposite large faces 6 and 7, one of them, namely the face designated by the reference 6, here being provided with fixed blades, such as 8, and the other delimiting the diffuser 5.

It can also be seen that the diaphragm 4 is provided with a set of through passages, such as 9, extending between the two faces 6 and 7 of the diaphragm so as to provide a connection between the diffuser 5 and the suction area of the compression stage situated immediately upstream of the wheel 2.

In the exemplary embodiment represented, the number of passages 9 corresponds to the number of fixed blades of the diaphragm 4, such that the passages each open, on the suction side, through an orifice 10 arranged between two fixed blades 8. Obviously, generally, the diaphragm 4 may comprise any number of such passages greater than one.

The passages are, however, preferably arranged in the thickness of the diaphragm 4 so as to extend, in an inclined manner, radially externally, between an area converging towards the rotor 3, on the suction side, and a radial area, situated in the diffuser, downstream of the wheel 2 (FIG. 3).

It has been found that the presence of such passages made it possible to compensate the instability phenomena causing the pumping of the machine, in particular for diffusers of very small dimensions, or for relatively low flow rates.

In this respect, it is standard practice to represent the flow rate on the basis of the volume flow rate sucked (Qv) from the front surface of the wheel S for a centrifugal stage and a peripheral speed U, from the following relationship:

$$\varphi = \frac{Qv}{S \cdot U}$$

Figure 4:
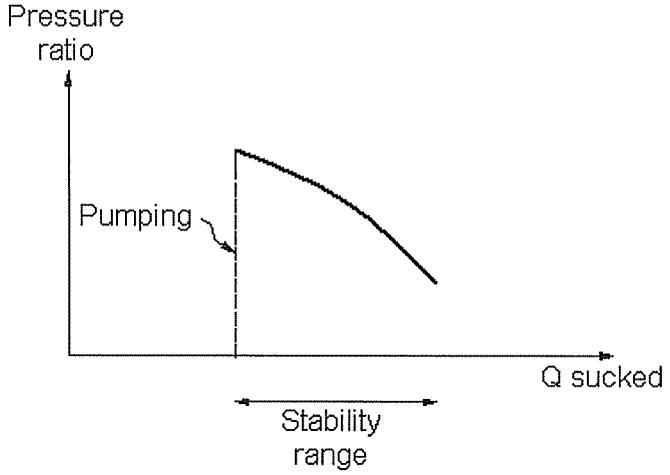
FIG. 4 is a characteristic curve of compression of a compressor illustrating the advantages associated with the invention.

It has been found that the presence of the passages 9 within the diaphragm 4 made it possible to eliminate the aerodynamic instabilities and in particular the pumping phenomena for relatively low flow rates corresponding to flow rate coefficients below 0.01, by creating a flow of gas from the diffuser to the upstream part of the bladed wheel through the passages, dependent on the pressure difference prevailing between the discharge area and the suction area, making it possible to increase the flow rate of the compressor and thereby maintain the compressor within its stability range (FIG. 4).

It will be noted in this respect that the quantity of gases recirculated, from discharge to suction, through the passages 9, which depends on the differential pressure on either side of the diaphragm, is consequently greater for low flow rates. It is, on the contrary, less great for relatively high flow rates for which the pumping phenomena are less likely to occur.

In other words, as illustrated in FIG. 4, in accordance with the invention, by creating this artificial circulation at the input of the compression stage, the sucked flow rate is artificially increased, so that the operating point of the compressor is pushed back into its stability range.

It will moreover be noted that the number and the dimension of the gas passages are adapted to suit the flow rate coefficient of the centrifugal stage, the number of rectifying bladings of the diaphragm and the quantity of gas necessary to maintaining the operating stability.

It will also be noted that the arrangement that has just been described constitutes an entirely passive device which requires no other monitoring device or measuring means and consequently constitutes a very reliable system. It is, moreover, applicable to all types of gas and pressure levels, while remaining of particular interest for stages with low flow rate coefficient inducing very small diffuser widths which are consequently difficult to implement and to monitor.

The diffuser which has just been described also offers a certain number of additional advantages.

It has in fact been found that no gas leak towards the outside was caused by the presence of the passages in the diaphragm, which contributes to the protection of the environment.

The operating principle of the diaphragm remains available for all higher pressure conditions.

It is, moreover, possible to use the technology of the centrifugal stages at very low flow rates while retaining operability in an industrial installation.

It has finally been found that the invention allowed for stable operation over a wide operating range compared to the centrifugal machines according to the prior art.

The invention claimed is:

1. A diaphragm for a compression stage of a compressor, comprising:

at least one set of through passages extending between two mutually opposite faces of the diaphragm, so as to create a flow of gas between the opposite faces depending on a pressure difference prevailing on either side of the diaphragm; and the at least one set of passages arranged regularly in the diaphragm and each extending, on one of the opposite faces of the diaphragm, between two fixed blades provided on the diaphragm, the number of passages corresponding to the number of fixed blades of the diaphragm, wherein the opposite faces correspond to different stages of the compressor.

2. A compression stage of a compressor, comprising:

a diaphragm receiving a gas supplied at the input of the compression stage;

a bladed wheel ensuring a compression of the gas obtained from the diaphragm; and an output diffuser, wherein the diaphragm comprises at least one set of through passages extending between a first face of the diaphragm directed towards a suction of gas into the compression stage and a second face directed towards the output diffuser so as to create a flow of gas between the output diffuser and an area of gas intake into the diaphragm, and wherein the at least one set of passages being arranged regularly in the diaphragm and each extending, on one of the faces of the diaphragm, between two fixed blades provided on the diaphragm, the number of passages corresponding to the number of fixed blades of the diaphragm.

3. A compressor comprising one or more diaphragms according to claim 1.

* * * * *